United States Patent [19]

Harris

[11] Patent Number: 4,625,620

[45] Date of Patent: Dec. 2, 1986

[54] BIPOD FOR A FIREARM

[76] Inventor: Gerald Harris, Harris Engineering, Barlow, Ky. 42024

[21] Appl. No.: 732,174

[22] Filed: May 7, 1985

[51] Int. Cl.[4] ..... F41C 29/00
[52] U.S. Cl. ..... 89/37.04; 42/94
[58] Field of Search ..... 42/94; 89/37.04, 40.06

[56] References Cited

U.S. PATENT DOCUMENTS 1,441,285 1/1923 Johnston et al. ..... 42/94

FOREIGN PATENT DOCUMENTS 183494 7/1922 United Kingdom ..... 42/94

*Primary Examiner*—Stephen C. Bentley
*Attorney, Agent, or Firm*—Harness, Dickey & Pierce

[57] ABSTRACT

A bipod for a rifle or the like has a base which is attachable to the sling swivel stud on the forearm of the rifle, a pair of adjustable telescoping legs pivotally attached to the base and which can be pivoted between a support position and a folded position generally parallel to the rifle barrel, and a pair of strut mechanisms each for selectably bracing a leg with respect to the base, each strut mechanism having resilient means for absorbing recoil of the rifle.

9 Claims, 8 Drawing Figures

BIPOD FOR A FIREARM

BACKGROUND AND SUMMARY OF THE INVENTION

The present invention relates to bipods and particularly to a bipod for attachment to the forearm of a firearm such as a rifle or the like.

Bipods are known for use on modern firearms to reduce tremor and improve their accuracy. Generally speaking, a bipod is best used when the shooter is in a prone position, sitting position or at a low rest position such as shooting off bench. Regardless of the shooting position chosen, use of a bipod can reduce fatigue and enhance the comfort of the shooter. In order to be most useful and versatile, bipod leg length should be easily adjustable and the bipod should be movable between a position supporting the firearm and a position which does not interfere with use of the firearm when the bipod is not in use.

A bipod can be constructed as a fixed part of the rifle or as an auxiliary device which can be removed from the rifle. Bipods which can be readily attached to a rifle and folded along the barrel thereof when not in use are especially convenient. One such bipod is taught in my U.S. Pat. No. 3,327,422 which issued June 27, 1967 for "Bipod for Attachment to a Firearm". The bipods which are the subject matter of the aforementioned patent can be attached to the sling stud provided on the forearm of many rifles for attachment of a sling swivel. The sling stud can be used for mounting various auxiliary devices, including bipods, as is disclosed in my U.S. Pat. No. 4,470,216 which issued Sept. 11, 1984 for "Bipod Mounting Device and Muzzle Brake".

In accordance with the present invention, an improved bipod is provided which has a base attachable to the sling stud of a rifle or the like and a pair of adjustable telescoping legs extending downwardly from the base for supporting the base and hence the forearm of a rifle attached thereto. The bipod of the present invention is reliable and convenient to adjust and operate in use and is well suited for manufacture. Further understanding of the present invention will be had from the following disclosure.

DESCRIPTION OF THE INVENTION

Figure 1:
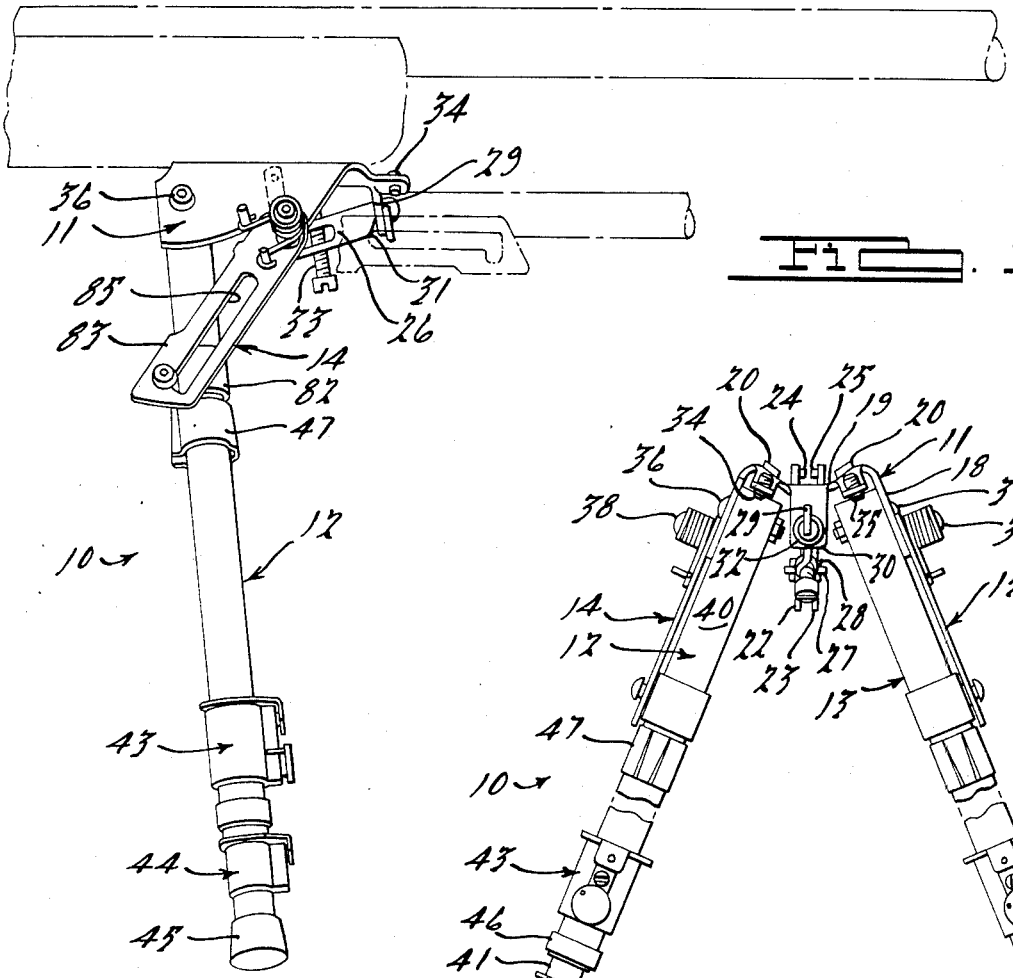
FIG. 1 is a side elevation of a preferred embodiment of the bipod of the present invention shown mounted on a rifle indicated in phantom lines and broken away with legs collapsed.
Figure 2:
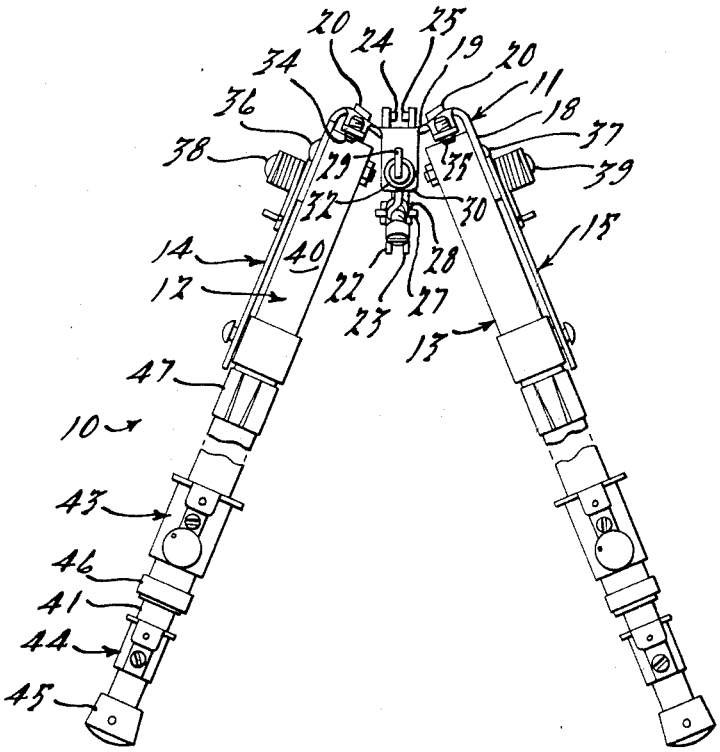
FIG. 2 is a front elevation of the bipod of FIG. 1.
Figure 4:
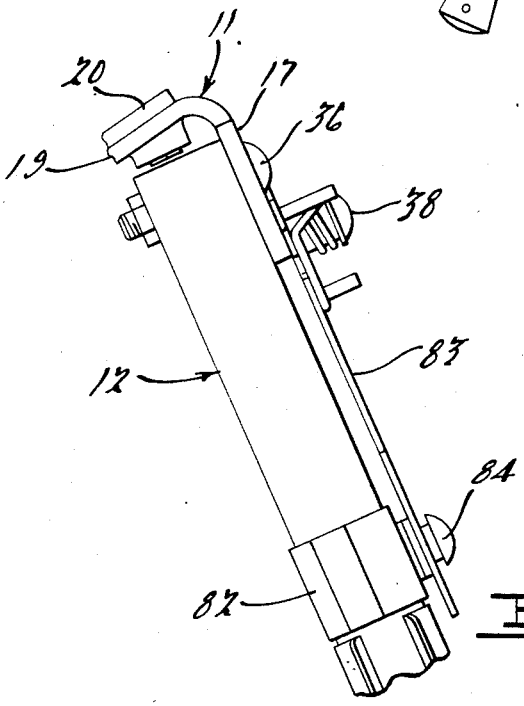
FIG. 4 is a rear elevation, broken away, showing the strut assembly of the bipod of FIG. 1.
Figure 3:
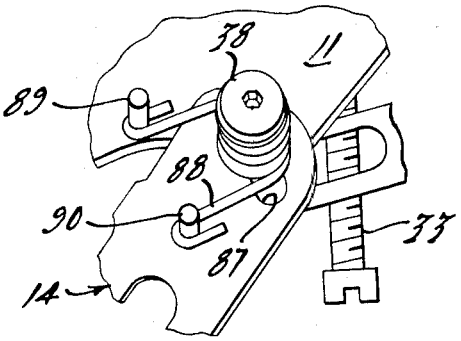
FIG. 3 is an enlarged, broken view of a portion of the structure shown in FIG. 1.

As will be further appreciated from the detailed description which follows, the preferred embodiment of the present invention offers an advantageous construction combining reliability and convenience in use. The bipod thus includes strut assemblies which allow ready folding of the bipod between support position for use and a folded position with legs extending generally parallel to the barrel of the firearm to which the bipod is attached. The strut assemblies provide means for absorbing recoil of the firearm to reduce forces thereby exerted on the bipod which would otherwise tend to damage bipod legs and/or displace the position of bipod legs on the ground or bench. Furthermore, the bipod has adjustable leg stops to allow adjustment of the exact angle to which the legs can be folded generally parallel to the barrel. Still further, the bipod has telescoping leg stops to quiet and buffer collapse of the legs and has infinitely adjustable leg lengths.

Now referring to the drawings, a preferred embodiment of the bipod of the present invention is shown in FIGS. 1–8 and indicated generally by the numeral 10. In use, bipod 10 is attached to a firearm, part of which is shown in phantom lines in FIG. 1. When not in use, bipod 10 can be detached from the firearm, if desired, or pivoted forwardly to a folded position generally parallel to the rifle barrel as shown in phantom lines in FIG. 1.

Generally speaking, bipod 10 comprises base 11, telescoping legs 12 and 13 and strut assemblies 14 and 15. Telescoping legs 12 and 13 are hingedly connected to base 11 and can be pivoted to a support position for use, as shown in full lines in FIGS. 1 and 2. As shown in FIG. 1 and discussed in more detail hereinafter, bipod 10 is adapted to attach to a conventional sling stud to provide a pair of telescoping legs 12 and 13 for supporting the forward portion of a rifle on the ground or on a bench rest or the like, generally for use in the sitting, prone, low rest or off bench shooting positions. In support position, telescoping legs 12 and 13 are braced by strut assemblies 14 and 15, respectively. As will be appreciated by those skilled in the art, the use of a rigid bipod minimizes tremor and increases the accuracy and comfort attendant to use of the rifle.

Base 11 comprises a metal stamping having sloping flanges 17 and 18 at opposite sides with web portion 19 extending therebetween. Web portion 19 is preferably arcuately shaped to follow the contour of a forearm. Base 11 preferably has pads 20 on the forearm side of sloping flanges 17 and 18 to protect the finish of a forearm of a rifle when clamped thereagainst.

Base 11 is adapted to attach to a conventional sling stud after the sling swivel has been removed therefrom, to provide a secure base upon which a forearm of a rifle or the like is supported. The means for attaching base 11 to the sling stud of a forearm is of a construction like that shown in my earlier U.S. Pat. No. 3,327,422, June 27, 1967 which is specifically incorporated by reference herein. Thus, base 11 has a pair of links 22 and 23 respectively carrying pins 24 and 25 which are press fit therein and are adapted to extend into the sling swivel aperture in a conventional sling stud. Links 22 and 23 freely extend through an aperture in the web portion 19 of base 11. Beneath base 11, the rearward end of lever 26 is sandwiched between links 22 and 23. As used herein, the term "rearward" means to the left, and the term "forward" means to the right, as viewed in FIG. 1.

A pivot pin 27 extends transversely through links 22 and 23, through the forward end of lever 26 and also through U-shaped spring clip 28 which embraces links 22 and 23 and the rearward end of lever 26 and urges the links against lever 26. The forward end 29 of lever 26 extends through a slot in downwardly extending flange 30 at the forward end portion of base 11 and is retained therein by shoulder 31 on lever 26 and ring 32 which extends through a hole in lever 26. The median portion of lever 26 is stamped and deformed to provide threaded opposing walls defining a passageway generally upwardly therethrough to threadably receive threaded element 33. When threaded element 33 is tightened, the upward end thereof contacts base 11 and lever 26 is drawn downwardly to thereby draw links 22 and 23 and the forearm to which they are attached downwardly to clamp base 11 and the forearm together.

Set screws 34 and 35 extend through threaded holes in flanges in the forward portion of web portion 19 of base 11. As will be set forth in more detail below, set screws 34 and 35 provide adjustable stop means when legs 12 and 13 are in a folded position.

Legs 12 and 13 are respectively pivotally attached to rearward portions of sloping flanges 17 and 18 of base 11 by bolts 36 and 37. Strut assemblies 14 and 15 are respectively pivotally attached to forward portions of sloping flanges 17 and 18 by bolts 38 and 39 which are threadably secured in threaded apertures in sloping flanges 17 and 18. Bolts 38 and 39 are selected to be of a length which does not extend inwardly, i.e. towards each other, beyond the respective flange 17 or 18 a distance which would interfere with the folding of legs 12 and 13 therepast. Leg 12 and strut assembly 14 are described in further detail below, it being appreciated that leg 13 is of construction analogous to leg 12 and strut assembly 15 is of construction analogous to strut assembly 14.

Leg 12 generally comprises three telescoping tubes of decreasing diameter: upper tube 40, middle tube 41 and lower tube 42. Means for selecting the extension of middle tube 41 out of upper tube 40 is provided by catch and friction lock assembly 43 which is fixedly attached to the lower end portion of upper tube 40. Means for selecting the extension of lower tube 42 out of middle tube 41 is provided by catch assembly 44 which is attached to the lower end portion of middle tube 41. Tubes 41 and 42 are biased towards a collapsed position by a spring which extends through the tubes between foot 45 of lower tube 42 to bolt 36. Buffer stop 46 and foot 45 provide means for limiting the collapse of middle tube 41 and lower tube 42 respectively. Upper tube 40 carries sliding leg stop 47 which limits the folding radius of leg 12 in cooperation with set screw 34.

Figure 5:
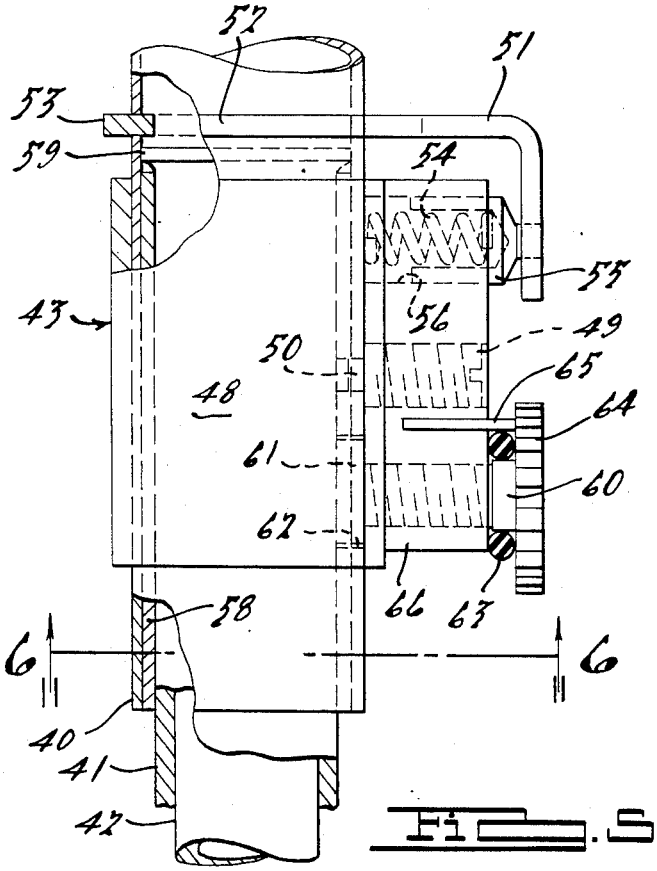
FIG. 5 is a side elevation, broken away, showing the catch and friction lock assembly of the bipod of FIG. 1 with legs extended.
Figure 6:
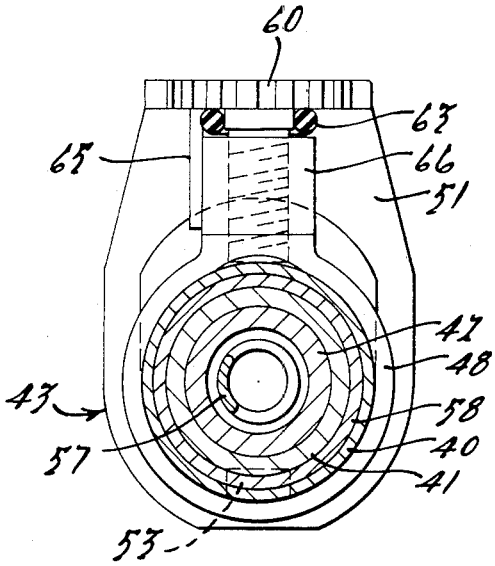
FIG. 6 is a sectional view taken along line 6—6 in FIG. 5.

Catch and friction lock assembly 43 has a generally annular body 48 which is positioned about the lower portion of upper tube 40 and locked thereon by set screw 49 which has a cylindrical end 50 extending into an opening in the side wall of upper tube 40 slightly larger in diameter than the end 50. Catch and friction lock assembly 43 provides two different means for adjusting the extent to which middle tube 41 extends from upper tube 40 and hence the length of leg 14. A first extension catch 41 has an annular portion 52 with protrusion 53 freely extending through an aperture in the side wall of upper tube 40. First extension catch 51 is L-shaped in side elevation and is biased rightwardly by spring 54 located in compression in spring guide 55 in aperture 56 in body 43 as shown in FIG. 5 to selectively engage cooperating notches (not shown in the figures) in the outer face of the side wall of middle tube 41 to lock the extension of middle tube 41 with respect to upper tube 40. It will be appreciated that various numbers of notches, or no notches at all, could be used as desired and that extension catch 51 can be manipulated leftwardly by the user to release middle tube 41 to allow its retraction by spring 57 or further extension by the user. When middle tube 41 is fully extended protrusion 53 will move rightwardly over the upper end of middle tube 41 to maintain the extension thereof against spring 57. The maximum extension of middle tube 41 is limited by tubular brass insert 58 the upper end of which abuts against flared end 59 of middle tube 41 when middle tube 41 is fully extended.

Catch and friction lock assembly 43 also has a headed screw 60 threadably disposed in body 48 which, when tightened, contacts a rectangular brass pad 61 disposed in rectangular recess 62 in upper tube 40 and brass insert 58. Brass pad 61 is adapted to exert clamping force against middle tube 41 to selectively provide a friction locking engagement between middle tube 41 and upper leg 40. An O-ring 63 made of resilient material is disposed just below the head 64 of headed set screw 60 to provide slight resistance to rotation thereof. Headed set screw 60 is selected to be of such a length that O-ring 63 is in contact with head 64 but allows tightening of headed set screw 60 against brass pad 61 to frictionally engage middle tube 41. A pin 65 is press fit in head 64 to limit the rotation thereof in either direction by abutting againt opposite shoulders of longitudinal ridge 66 in body 48.

Figure 7:
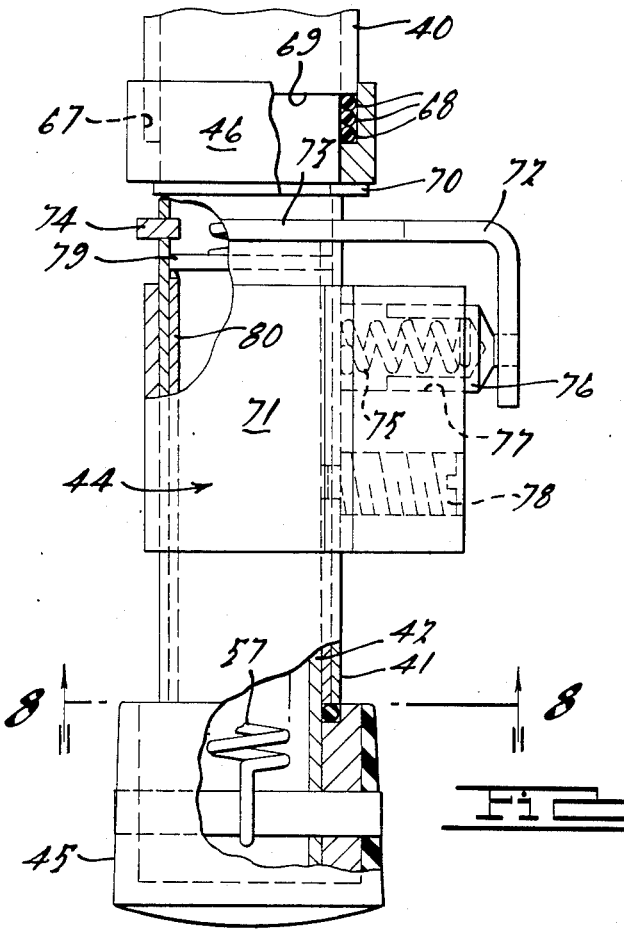
FIG. 7 is a side elevation, broken away, showing the buffer and catch assembly of the bipod of FIG. 1 with legs extended.
Figure 8:
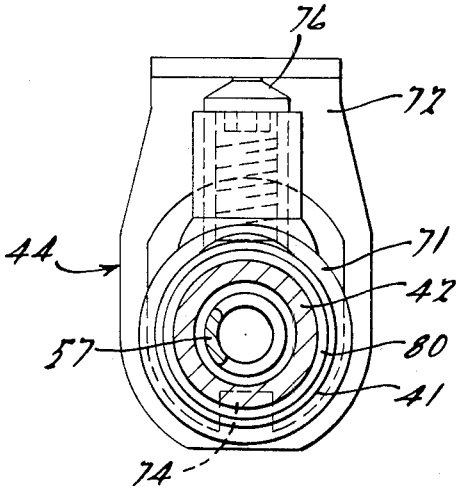
FIG. 8 is a sectional view taken along line 8—8 in FIG. 7.

Disposed at the lower portion of middle tube 41 is support ring 46. As best shown in FIG. 7, support ring 46 has an annular recess 67 within which are disposed a plurality of resilient O-rings 68. O-rings 68 provide a resilient means for cushioning the contact between the bottom edge 69 of upper tube 40 and hold support ring 46 against a snap ring 70 which is snappingly located in an annular groove in middle tube 41.

Disposed below support ring 46 on middle tube 41 is buffer and catch assembly 44. Buffer and catch assembly 44 is of a construction generally analogous to catch and friction lock assembly 43 except that it will be appreciated that a headed screw analogous to headed screw 60 is not necessary in buffer and catch assembly 44 since headed screw 60 is available in catch and friction lock assembly 43 for fine adjustments of the length of leg 12. Thus, buffer and catch assembly 44 has a body 71, extension catch 72 with an annular portion 73 having a projection 74 adapted to extend through an aperture in the side wall of middle tube 41 and snap over the end of lower tube 42 when the end of lower tube 42 is pulled therepast. Extension catch 72 is L-shaped in side elevation and is biased rightwardly as viewed in FIG. 7 by spring 75 located within spring guide 76 within hole 77. Body 71 is locked in place on middle tube 41 by set screw 78 in a manner analogous to that of set screw 49 of catch and friction lock assembly 43. The upper end of lower tube 41 is flared outwardly at flange 79 to a larger diameter than the remainder of lower tube 42 and abuts against the upwardly facing end of tubular brass insert 80 to provide stop means for limiting maximum extension of lower tube 42 out of middle tube 41. Minimum extension of lower tube 42 is provided by foot 45 abutting against the downwardly facing end of middle tube 41.

Strut assembly 14 braces leg 12 to base 11 and comprises a split ring bracket 82 located on upper tube 40 of leg 12 and clamped thereon by shoulder screw 84 which also attaches strut 83 to split ring bracket 82. Strut 83 has an L-shaped elongated slot 85 through which shoulder screw 84 slidingly extends. Shoulder screw 84 abuts against a shoulder of strut 83 defining slot 85 transverse to the direction of the longer portion of slot 85 when leg 12 is in a downward or support position thus locking leg 12 in a rigid manner. Strut 83 is pivotally attached to flange 17 of base 11 by headed shoulder screw 38 which is threadably secured in a threaded hole in flange 17. Shoulder screw 38 extends through an oblong slot 87 in strut 83 and carries spring 88 which has ends compressed between hinge pins 89 and 90 which are press fit into flange 17 and strut 83, respectively. When leg 12 is in the support position, spring 88 urges strut 83 downwardly and shoulder screw 38 into the top portion of oblong slot 87. When the lower end of strut 83 is manipulated rearwardly, shoulder screw 84 aligns with the length of slot 85 allowing folding of leg 12 forwardly with spring 88 assisting. Once folded, spring 88 maintains leg 12 in the folded position.

Oblong hole 87 provides means for absorbing recoil from the firearm to protect the bipod legs from undue stress. Thus, in recoil, base 11 can move rearwardly causing legs 12 to pivot forwardly drawing shoulder screw 38 downwardly in oblong hole 87. This not only protects the legs from damage but also assists in maintaining the footing of the bipod.

When securing bipod 10 to a forearm, the lower ends of 22 and 23 are pressed together to separate pins 24 and 25 so that they can be positioned for insertion into the sling swivel stud. Then spring clip 28 presses against the links to hold pins 24 and 25 in the aperture while threaded element 33 is tightened against base 11 to draw lever 26 downwardly to clamp the base 11 against the forearm. When bipod 10 is to be removed from the firearm, threaded element 33 is loosened and then the lower ends of links 22 and 23 are pressed together to separate pins 24 and 25 to allow their removal from the sling swivel stud. Thus, the bipod can be readily attached and removed from the firearm.

After attaching bipod 10 to the forearm, bipod 10 can be folded in a carry position as indicated in phantom lines in FIG. 1 or folded downwardly to assume a ready position as shown in full lines in FIG. 1. Bipod 10 is maintained in the carry position by spring 88 but can be readily manipulated to the support position by grasping one or both legs and pivoting the legs downwardly whereupon shoulder screw 84 will lock into position behind shoulder in the L-shaped slot 85. The buffer and stop arrangement provides a pull out leg which is quick to get into action and quick to retract but does so quietly. To move bipod 10 from the support position to the folded position, strut 83 and, of course, the corresponding strut associated with leg 13, are manipulated rearwardly so that the shoulder screw 84 is clear to move the length of slot 85.

The bipod legs normally fold close to the rifle barrel. Means for positioning each leg in a folding position is provided by leg stop 47 slidably attached to leg 14 and/or by set screw 34 which offer adjustment means independently or in combination for adjusting the arc through which leg 12 can pivot. Base 11 can be selectively sized so that the set screw 34 contacts leg stop 47, leg 14 or split ring bracket 82.

It will be appreciated that the foregoing description and accompanying drawings illustrate a preferred embodiment of this invention and that various changes, modifications, and variations may be made therein without departing from the spirit and scope of the invention as defined in the following claims.

What is claimed is:

1. A bipod having a supporting base and a pair of legs pivotally attached thereto, means for attaching said base to a firearm and a pair of strut assemblies, each for selectively bracing one leg in a support position and a folded position with respect to said base, each said strut having a strut with an L-shaped slot therein and said strut assembly being pivotally connected to an associated leg by a fastening element extending through said L-shaped slot, and each said strut assembly including means for biasing said strut assembly towards a folded position.

2. A bipod as in claim 1 wherein each of said struts has an elongated slot through which a fastening element extends for pivotally attaching said strut to said base, and wherein said slot is elongated in a direction generally parallel to the leg associated with said strut to allow sliding movement of said fastening element in said slot in response to recoil of said firearm.

3. A bipod as in claim 1 including an adjustable leg stop for positioning each of said legs in a folded position, said leg stop including an annular ring slidably attached to said leg.

4. A bipod as in claim 1 wherein each said leg carries a telescoping leg stop comprising a ring afixed to said leg, said ring having a recess and at least one resilient ring positioned within said recess.

5. A bipod as in claim 1 wherein each said leg comprises one smaller diameter tube telescoped withing a larger diameter tube, and said larger diameter tube carries a friction lock, said friction lock comprising an annular body fixedly attached to said leg, said larger diameter tube having an aperture in a side wall thereof, said body being positioned over said aperture, a pad in said aperture, a threaded hole extending through said body between said aperture and an outside surface of said body and a threaded element extending through said threaded hole and adopted to adjustably contact said pad to selectively apply clamping force between said smaller diameter tube and said larger diameter tube.

6. A bipod as in claim 5 wherein said pad comprises brass.

7. A bipod as in claim 1 wherein said biasing means is a spring compressed between a first spring stop on said strut and a second spring stop on said base.

8. A bipod as in claim 1 including adjustable leg stops for positioning each of said legs in a folded position, leg stops including a set screw threadably extending downwardly through said base.

9. A bipod as in claim 8 wherein said leg stop includes an annular ring slidably attached to said leg and adapted to contact said set screw when said leg is in a folded position.

* * * * *